US005145000A

United States Patent [19]

Kluppel

[11] Patent Number: 5,145,000

[45] Date of Patent: Sep. 8, 1992

[54] STEAM CONDENSATE STORAGE TANK WITH NON-FREEZING FEATURE

[75] Inventor: George E. Kluppel, Richmond, Tex.

[73] Assignee: Hudson Products Corporation, Houston, Tex.

[21] Appl. No.: 792,822

[22] Filed: Nov. 15, 1991

[51] Int. Cl.[5] ..... F28F 9/08

[52] U.S. Cl. ..... 165/113; 165/112; 165/134.1

[58] Field of Search ..... 165/112, 113, 134.1, 165/901, 917

[56] References Cited

U.S. PATENT DOCUMENTS

| | | | |
|---|---|---|---|
| 3,705,621 | 12/1972 | Schoonman | 165/112 |
| 3,968,836 | 7/1976 | Larinoff | 165/111 |
| 4,177,859 | 12/1979 | Gatti et al. | 165/11 |
| 4,240,502 | 12/1980 | Larinoff | 165/112 |
| 4,585,054 | 4/1986 | Köprunner | 165/112 |
| 4,905,474 | 3/1990 | Larinoff | 60/692 |

*Primary Examiner*—Allen J. Flanigan

*Attorney, Agent, or Firm*—Robert J. Edwards; Michael L. Hoelter

[57] ABSTRACT

A condensate storage tank assembly comprises a tank section having a condensate outlet at a lower end thereof. An upwardly enlarged steam chamber is connected to the upper end of the tank section and receives a condensate drain line which extends from the drain pot of a condenser. The upwardly enlarged steam chamber surrounds a portion of the condensate drain line at least up to the highest level of condensate in the drain line. A steam line from the source of steam which also feeds the condenser, is connected to the upper end of the tank section for supplying steam above the condensate level in the tank section. The steam heats the condensate drain line in the steam chamber to avoid freezing the condensate in the drain line. An upwardly enlarged deaerator may also be provided on the upper end of the tank section. The drain pot is also supplied with steam from the condenser for avoiding freezing of condensate in the condensate drain lines which supply condensate from the condenser to the drain pot.

20 Claims, 2 Drawing Sheets

STEAM CONDENSATE STORAGE TANK WITH NON-FREEZING FEATURE

FIELD OF THE INVENTION

The present invention relates in general to vapor condensing apparatus, and in particular to a new and useful condensate storage tank having means defining a steam chamber for surrounding at least part of a condensate line, connected between the drain pot of an air cooled steam condenser and the condensate storage tank, for preventing condensate in the condensate line from freezing.

Air cooled vapor condensers which are used in particular for condensing steam, generally comprise an inlet header for receiving the steam. The steam may for example be the spent steam from a steam turbine.

U.S. Pat. No. 4,129,180 discloses such a vapor condensing apparatus which includes a plurality of air cooled heat exchanger tube bundles which extend downwardly in the form of an inverted V, from the inlet header. Each bundle is divided into rows with each row terminating at a lower rear header. A condensate drain pot is connected to each bundle and receives condensate through a drain tube from each row in the bundle. Condensate is drained from the drain pot through a drain line which has an opening extending above the bottom of the pot. The opening acts to form a weir flow into the drain line and to establish a distinct water level in the pot. The condensate lines from the individual rows each extend to below a condensate level in the pot which thus acts as a pressure seal isolating one row from the other.

A significant object of U.S. Pat. No. 4,129,180 is to vent so called non-condensibles, such as air, from the condenser. This avoids the freezing of condensate in pockets of this non-condensible air which would be at a lower ambient temperature than areas in the condenser which contain steam.

Other improvements in air cooled vapor condensers are disclosed in U.S. Pat. No. 4,657,070, U.S. Pat. No. 4,518,035 and U.S. Pat. No. 4,296,802.

During cold weather operation of an air cooled vapor or steam condenser, the danger of water freezing in drain lines remains a significant problem which has not been fully overcome.

SUMMARY OF THE INVENTION

An object of the present invention is to provide a condensate storage tank for an air cooled vapor condenser which is structured to avoid freezing of water in drain lines which supply condensate to the tank.

Another object of the present invention is to provide an arrangement for avoiding the freezing of condensate in drain lines extending in the drain pot of an air cooled vapor condenser.

According to the present invention, the condensate storage tank is provided with means defining a steam chamber which surrounds at least part of a condensate line connected between the drain pot and the tank for supplying condensate to the tank. Advantageously, the steam chamber is supplied with steam from the source of steam which feeds the inlet header of the vapor condenser. The steam chamber extends at least to the highest condensate level that is anticipated in the condensate drain line during normal operation or when the drain line is closed for isolating the condensate tank from the drain pot.

According to the present invention, the drain pot is also supplied with steam for keeping the interior of the drain pot warm above the condensate level therein and around the drain lines from the tube bundle rows.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
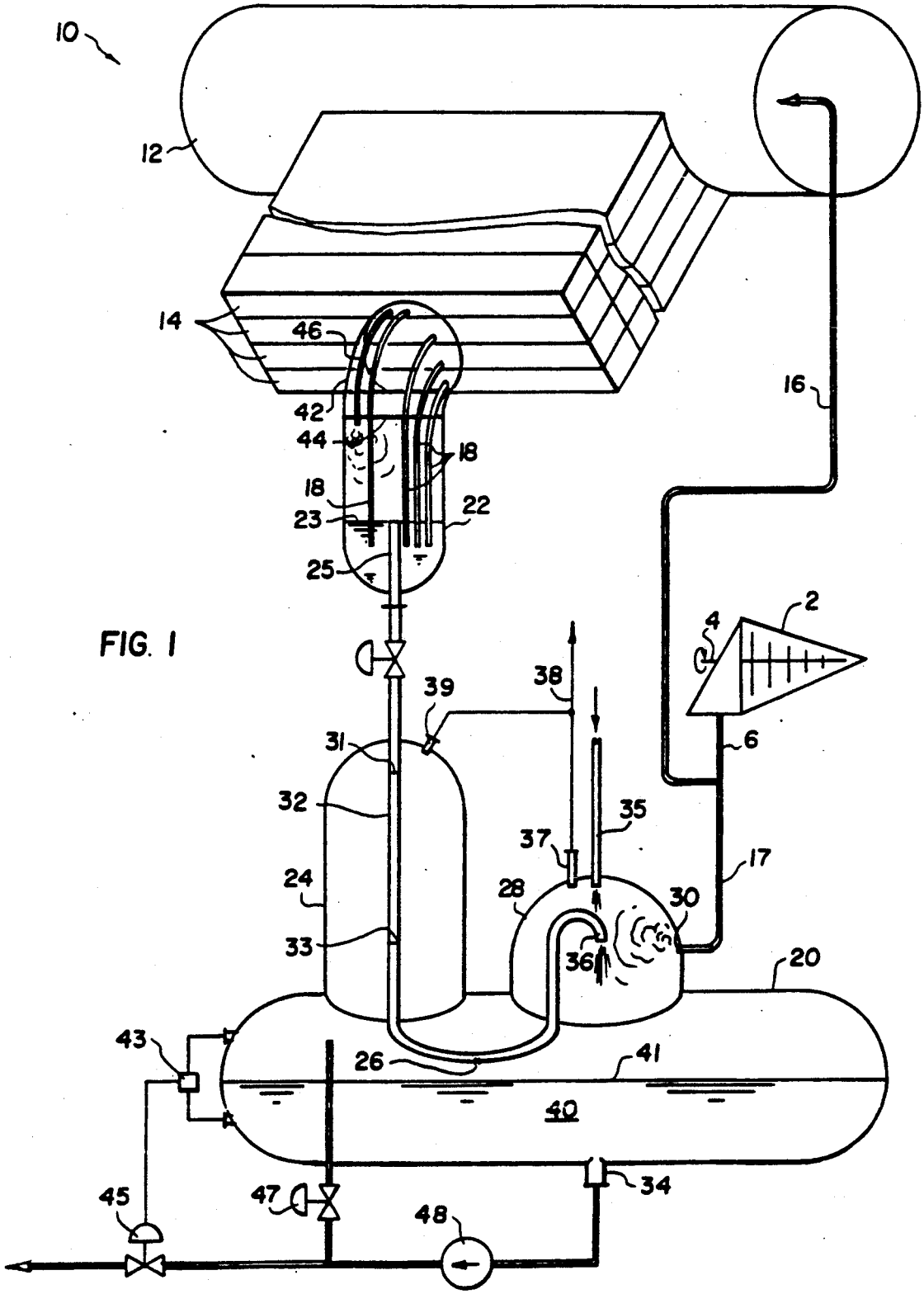
FIG. 1 is a schematic diagram showing an air cooled vapor condenser with drain pot and condensate tank constructed according to the present invention.

Referring to FIG. 1 in particular, the invention embodied therein comprises a vapor or steam condensate storage tank 20 which includes an upwardly enlarged dome shaped enclosure 24 which define a steam chamber. Tank 20 also includes an upwardly enlarged dome shaped deaerator section 28.

Tank 20 stores steam condensate (water) 40 which fills approximately one-half of tank 20 up to water level 41. This level is maintained by controlling the flow of condensate out of tank 20 through tank outlet 34 and over a level control valve 45. A level control unit 43 which is of known design, has level sensors and controls the opening and closing of valve 45 as a function of level 41 to maintain the desired height of level 41.

For low flow operation, where insufficient condensate is being supplied through tank 20, a recycling line with recycling valve 47 is provided which operates in conjunction with a recycling pump 48 for recycling condensate from the tank outlet 34 back into the tank 20.

Condensate for tank 20 is supplied from an air cooled vapor condenser generally designated 10 having a steam inlet header 12 which receives spent steam from a turbine 2 over a spent steam outlet 6 and a steam branch line 16. The spent steam is received from turbine 2 after the steam has been used to turn a rotor and shaft 4 in the turbine.

As disclosed in detail in the above-identified U.S. Pat. No. 4,129,180, condenser 10 includes a plurality of downwardly inclined, air cooled, tube bundle rows 14 which are stacked one above the other. The upper ends of the tube bundles are connected to the inlet header 12 for receiving steam which is condensed near the bottom of the tube bundle rows 14 at outlet headers which are each connected by a separate condensate line 18, to the interior of a drain pot 22. Condensate is maintained at a level 23 in drain pot 22 by a pot drain line 25 which has an upper end that extends to level 23 in drain pot 22 and receives a weir flow of condensate from level 23 into the upper opening of drain line 25.

The condensate is then supplied through a valve to condensate drain line 32 connected to condensate storage tank 20.

When the valve connected to drain line 25 is open for supplying condensate from the condenser 10 to the tank 20, condensate in line 32 rises to an operating water level 33. When the valve connected to drain line 25 is closed for isolating tank 20 from condenser 10, the condensate in line 32 rises to an isolated water level 31.

According to the present invention, tank 20 is provided with means in the form of the upwardly enlarged dome shaped structure 24, which form the steam chamber that engages around condensate drain line 32 and extends at least as high as the isolated water level 31.

The upper volume of tank 20 and steam chamber 24 is supplied with warming steam over a steam line 17 which branches from spent steam line 6. Steam line 17 terminates at a steam inlet 30 which communicates with the interior of the dome shaped deaerator 28 which also extends upwardly from tank 20.

In the embodiment of FIG. 1, drain line 32 forms a U-shaped trap or loop seal with a drain line exit 36 which extends up into the top of deaerator section 28. A drain hole 26 is provided at the bottom of the loop seal.

Additional condensate from other sources can also be provided to tank 20 through an auxiliary condensate line 35 opening into the deaerator section 28. Non-condensible gas (e.g. air) which becomes trapped near the top of steam chamber 24 and deaerator 28 is removed by non-condensible vents 37 and 39 which are connected to a non-condensible circuit 38 for removal from the storage tank 20. The presence of non-condensible gases reduces the temperature in local area of the tank 20 which may cause a reduction in temperature and potential freezing of condensate in lines extending through these portions of the tank.

According to the present invention, the steam pot 22 which has drain lines 18 from the tube bundle rows 14 that have outlets extending to below condensate level 23, also includes a cover plate 44 which defines an open space above condensate level 23. This space is supplied with steam over line 46 from the upper row 14, to keep this space warm and to avoid freezing of condensate in lines 18.

Figure 2:
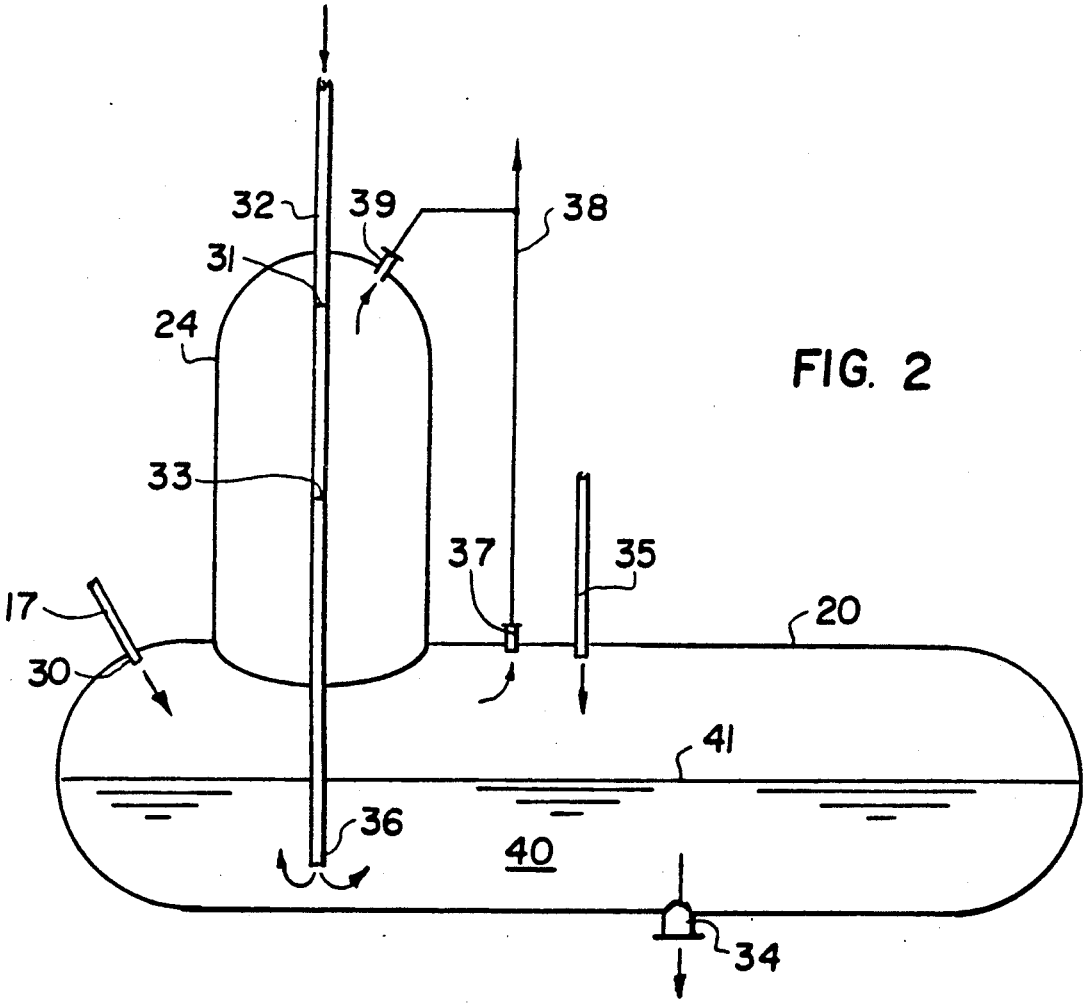
FIG. 2 is a schematic representation of an alternate embodiment for the condensate tank.

FIG. 2 shows an alternate embodiment of the invention wherein the same reference numerals are used to designate the same or similar parts. In FIG. 2, condensate storage tank 20 does not include a deaerator section. Instead, drain line 32 having isolated level 31 and operating level 33, supplies condensate to an outlet 36 which is below the condensate level 41, approximately half filling the tank 20. Auxiliary condensate is supplied over auxiliary line 35 while steam is supplied to the upper area of tank 20 over line 17 which opens at opening 30. Non-condensible gases are vented by vent 39 in the steam chamber 24 and vent 37 which is now near the upper end of tank 20.

While the specific embodiments of the invention have been shown and described in detail to illustrate the application of the principles of the invention, it will be understood that the invention may be embodied otherwise without departing from such principles.

What is claimed as invention is:

1. A condensate storage tank assembly coupled to a condenser, comprising:

a. a tank section having a condensate outlet at a lower end thereof for draining condensate from the tank section;

b. level control means connected to the tank section for maintaining a selected condensate level in the tank section at an intermediate location between the lower end of the tank section and an upper end of the tank section;

c. a condensate drain line extending into the tank section for supplying condensate thereto from the condenser, the condensate drain line having an operating condensate level therein to which condensate extends during the supply of condensate from the condenser to the tank section, and an isolated condensate level to which condensate rises when the tank section is isolated from the condenser;

d. chamber forming means connected to the tank section for defining an upwardly enlarged steam chamber communicating with the upper end of the tank section, the steam chamber being engaged around the condensate drain line at least up to the isolated condensate level; and e. a steam line connected to the tank section for supplying steam to the tank section above the selected condensate level in a tank section and within the steam chamber for preventing condensate in the drain line up to the isolated condensate level from freezing.

2. An assembly according to claim 1 wherein the chamber forming means comprises an upwardly enlarged dome shaped enclosure connected to the tank section and extending above the upper end of the tank section.

3. An assembly according to claim 2 wherein the condensate drain line has a lower outlet opening extending to below the selected condensate level in the tank section.

4. An assembly according to claim 2 including a deaerator section connected to the tank section and defining an upwardly enlarged deaerator chamber communicating with the upper end of the tank section, the condensate drain line including a loop seal extending into the upper end of the tank section and having an outlet extending into the deaerator chamber.

5. An assembly according to claim 4 wherein the steam line is connected to the deaerator section for discharging steam into the deaerator chamber.

6. An assembly according to claim 2 wherein the steam line is connected to the tank section for discharging steam into the upper end of the tank section.

7. An assembly according to claim 1 wherein the level control means comprises a level control valve connected to the outlet of the tank section, and a level control sensor connected to the tank section and operatively connected to the level control valve for opening and closing the level control valve to maintain the selected condensate level in the tank section.

8. An assembly according to claim 1 wherein the chamber forming means comprises an upwardly enlarged dome shaped enclosure connected to the tank section and engaged around at least a portion of the drain line.

9. An assembly according to claim 8 including a non-condensible vent connected to the dome shaped enclosure near an upper end of the enclosure.

10. An assembly according to claim 9 including a second upwardly enlarged dome shaped enclosure defining a deaerator chamber communicating with the upper end of the tank section, the steam line being connected to the second upwardly enlarged enclosure for supplying steam to the deaeration chamber, and a second non-condensible vent connected to the second enclosure near an upper end of the second enclosure.

11. An assembly according to claim 10 including a loop seal connected at a discharged end of the condensate drain line in the tank section, said loop seal having an outlet extending into the deaeration chamber.

12. An assembly according to claim 11 including an auxiliary drain line connected to the second enclosure for supplying additional condensate to the tank section through the deaeration chamber.

13. An assembly according to claim 1 including a drain pot connected to the condensate drain line at an upper end of the condensate drain line spaced from the tank section, at least one second condensate drain line for supplying condensate from a condenser to the drain pot, and a second steam line connected to the drain pot for supplying steam thereto from a condenser for avoiding freezing of condensate in the at least one second condensate drain line.

14. An assembly according to claim 13 wherein the upper end of the first-mentioned condensate drain line extends into the darn pot up to a condensate level in the drainpot, the at least one second condensate drain line extending to the drain pot to blow the condensate level in the drain pot, a cover plate in the drain pot above the condensate level in the drain pot, the second steam line and the at least one second condensate line extending through the cover plate, the second steam line having an outlet above the condensate level for supplying steam to a volume in the drain pot between the cover plate and the condensate level in the drain pot.

15. A condenser assembly comprising:

a. a steam inlet header for receiving steam to be condensed;

b. at least one stack of plural tube bundle rows extending downwardly at an inclined angle from the steam inlet header for receiving steam from the header, each tube bundle row having a lower outlet header for discharging condensate into a drain pot;

c. a condensate drain line having an upper end connected to the drain pot, the condensate drain line having a lower end;

d. a tank section having a condensate outlet at a lower end thereof for draining condensate from the tank section;

e. level control means connected to the tank section for maintaining a selected condensate level in the tank section at an intermediate location between the lower end of the tank section and an upper end of the tank section;

f. the lower end of the condensate drain line extending into the tank section for supplying condensate thereto from a condenser, the condensate drain line having an operating condensate level therein to which condensate extends during the supply of condensate from a condenser to the tank section, and an isolated condensate level to which condensate rises when the tank section is isolated from the condenser;

g. chamber forming means connected to the tank section for defining an upwardly enlarged steam chamber communicating with the upper end of the tank section, the steam chamber being engaged around the condensate drain line at least up to the isolated condensate level; and h. a steam line connected to the tank section for supplying steam to the tank section above the selected condensate level in a tank section and within the steam chamber for preventing condensate in the drain line up to the isolated condensate level form freezing.

16. An assembly according to claim 15 wherein the chamber forming means comprises an upwardly enlarged dome shaped enclosure connected to the tank section and extending above the upper end of the tank section.

17. An assembly according to claim 15 including a deaerator section connected to the tank section and defining an upwardly enlarged deaerator chamber communicating with the upper end of the tank section, the condensate drain line including a loop seal extending into the upper end of the tank section and having an outlet extending into the deaerator chamber.

18. An assembly according to claim 15 wherein the chamber forming means comprises an upwardly enlarged dome shaped enclosure connected to the tank section and engaged around at least a portion of the drain line.

19. An assembly according to claim 15 including a drain pot connected to the condensate drain line at an upper end of the condensate drain line spaced from the tank section, at least one second condensate drain line for supplying condensate from a condenser to the drain pot, and a second steam line connected to the drain pot for supplying steam thereto from a condenser for avoiding freezing of condensate in the at least one second condensate drain line.

20. An assembly according to claim 19 wherein the upper end of the first-mentioned condensate drain line extends into the drain pot up to a condensate level in the drain pot up to a condensate level in the drain pot, at least one second condensate drain line extending to the drain pot to below the condensate level in the drain pot, a cover plate in the drain pot above the condensate level in the drain pot, the second steam line and the at least one second condensate line extending through the cover plate, the second steam line having an outlet above the condensate level for supplying steam to a volume in the drain pot between the cover plate and the condensate level in the drain pot.

* * * * *